US007874928B2

(12) United States Patent
Katayama

(10) Patent No.: US 7,874,928 B2
(45) Date of Patent: Jan. 25, 2011

(54) PERFORMANCE MEASURING DEVICE FOR GOLF CLUB

(75) Inventor: Shu Katayama, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 593 days.

(21) Appl. No.: 11/195,720

(22) Filed: Aug. 3, 2005

(65) Prior Publication Data

US 2006/0030432 A1 Feb. 9, 2006

(30) Foreign Application Priority Data

Aug. 6, 2004 (JP) ..... P2004-230383

(51) Int. Cl.
*A63B 57/00* (2006.01)
*A63B 69/36* (2006.01)

(52) U.S. Cl. ..... 473/198; 473/131; 473/151; 473/190; 473/192

(58) Field of Classification Search ..... 473/140, 473/141, 150–156, 190, 192, 199, 200, 209, 473/220–225, 131, 198
See application file for complete search history.

(56) References Cited

U.S. PATENT DOCUMENTS 4,713,686 A 12/1987 Ozaki et al.
5,471,383 A 11/1995 Gobush et al.
5,475,441 A * 12/1995 Parulski et al. ..... 348/552
5,768,151 A 6/1998 Lowy et al.
5,917,545 A * 6/1999 Kowno et al. ..... 348/231.9
6,042,483 A 3/2000 Katayama
6,061,746 A * 5/2000 Stanley et al. ..... 710/10
6,163,344 A * 12/2000 Kawamura et al. ..... 348/552

(Continued)

FOREIGN PATENT DOCUMENTS

JP 2001-056251 A 2/2001

(Continued)

OTHER PUBLICATIONS

Pentium III datasheet, downloaded from http://download.intel.com/support/processors/pentiumiii/sb/24965705.pdf, Mar. 16th, 2008.*

(Continued)

*Primary Examiner*—Peter DungBa Vo
*Assistant Examiner*—Matthew D. Hoel
(74) *Attorney, Agent, or Firm*—Sughrue Mion, PLLC

(57) ABSTRACT

A performance measuring device for a golf club that measures a motion state of a golf ball hit by the golf club and displays a measurement result, includes a camera part that takes a picture of the hit golf ball, a sensor part that detects a passage of the golf club hitting the golf ball and sends a trigger signal of deciding a photographing timing of the golf ball to the camera part, a control box having storage unit that stores an image of the golf ball photographed by the camera part and a USB interface that sends the image, and a mobile type computer having an arithmetical operation unit that analyzes the image, and a liquid crystal monitor that displays an analytic result. The mobile type computer includes a central processing unit having a clock frequency of 500 MHz or more, and a basic software achieving multitask and multiwindow.

12 Claims, 2 Drawing Sheets

U.S. PATENT DOCUMENTS

| | | | | |
|---|---|---|---|---|
| 6,251,014 | B1 * | 6/2001 | Stockdale et al. | 463/16 |
| 6,431,990 | B1 | 8/2002 | Manwaring | |
| 6,707,314 | B2 * | 3/2004 | Kasahara et al. | 326/38 |
| 6,728,680 | B1 * | 4/2004 | Aaron et al. | 704/271 |
| 6,742,385 | B2 | 6/2004 | Katayama | |
| 6,758,759 | B2 * | 7/2004 | Gobush et al. | 473/131 |
| 2001/0023209 | A1 | 9/2001 | Yamamoto | |
| 2002/0098897 | A1 * | 7/2002 | Manwaring | 473/151 |
| 2002/0155896 | A1 * | 10/2002 | Gobush et al. | 473/197 |
| 2003/0054880 | A1 * | 3/2003 | Lam et al. | 463/29 |
| 2004/0127303 | A1 | 7/2004 | Teraoka | |
| 2005/0193154 | A1 * | 9/2005 | Devine | 710/62 |

FOREIGN PATENT DOCUMENTS

| | | | |
|---|---|---|---|
| JP | 3187748 | B2 | 5/2001 |
| JP | 2001-264016 | A | 9/2001 |
| JP | 2003-57258 | A | 2/2003 |
| JP | 2003-117044 | A | 4/2003 |
| JP | 2004-135908 | A * | 5/2004 |
| WO | WO 01/37105 | A1 * | 5/2001 |
| WO | WO 03/073422 | A1 | 9/2003 |

OTHER PUBLICATIONS

Machine translation of JP 2004-135908 A, downloaded from http://dossier1.ipdl.inpit.go.jp, Sep. 9, 2008.* http://www.weco.com/news_site/pdf/OPSIS1300ASC.pdf, downloaded Apr. 12, 2009.*

"A High Frame Rate CCD Camera with Region-of-Interest Capability," by Monacos, et al., 2001 IEEE, 0-7803-6599-2/01, pp. 3-1513 to 3-1522, downloaded from ieeexplore.ieee.org Apr. 12, 2009.*

Japanese Office Action dated Jul. 1, 2008.

Japanese Office Action dated Nov. 18, 2008.

* cited by examiner

PERFORMANCE MEASURING DEVICE FOR GOLF CLUB

BACKGROUND OF THE INVENTION

1. Field of the Invention

The present invention relates to a performance measuring device for measuring the motion state of a golf ball hit by a golf club, and displays the measurement result.

2. Description of the Related Art

Conventionally, a performance measuring device for a golf club that makes the performance measurement of the golf club by taking a picture of a golf ball hit by the golf club with a camera, analyzing the initial conditions (speed, angle and amount of rotation) of the hit golf ball, based on the taken image, and calculating the carry from the analytical result by simulation, and displays the measurement result has been well known (e.g., refer to Japanese Patent No. 3,187,748).

In this case, the conventional performance measuring device including a control part having a mother board (CPU board) that is the arithmetical operation unit and an image processing board that analyzes the image of the golf ball under the flight, because it was diverted from the device intended for developing and evaluating the golf club, in which the control part was a general-purpose desktop type computer, and the mother board and the image processing board were built into a chassis (case). Moreover, it was provided with a mouse, a keyboard and a monitor, besides the above-mentioned control part.

However, the above-mentioned conventional performance measuring device was remarkably troublesome to move, when the equipment was moved to another measurement place, because the control part (desktop type computer or equipment that belongs to it) was large-scale, and the mouse, the keyboard, and the monitor were provided separately, in which the incidence of trouble due to vibrations at the time of movement or trouble due to dust was high.

Moreover, when the conventional performance measuring device for the golf club was employed, it took considerable time to connect a power cable or a communications cable, a wide place was needed to install the control part, and data must be copied onto the medium such as a flexible disk to analyze the measured data.

SUMMARY OF THE INVENTION

This invention has been achieved in the light of the above-mentioned problems, and provides a performance measuring device for a golf club in which the movement of equipment is simple, the trouble due to vibrations at the time of movement or trouble due to dust is unlikely to occur, it takes less time to connect a power cable or a communications cable, a wide place is not needed to install the control part, and data is not required to be copied onto the medium such as a flexible disk to analyze the measured data.

According to an aspect of the present invention, a performance measuring device for a golf club that measures a motion state of a golf ball hit by the golf club and displays a measurement result, including a camera part that takes a picture of the hit golf ball, a sensor part that detects a passage of the golf club hitting the golf ball and sends a trigger signal of deciding a photographing timing of the golf ball to the camera part, a control box having storage unit that stores an image of the golf ball photographed by the camera part, and a USB interface that sends the image, and a mobile type computer having an arithmetical operation unit that analyzes the image sent via the USB interface of the control box, and a liquid crystal monitor that displays an analytic result. The mobile type computer includes a central processing unit (CPU) having a clock frequency of 500 MHz or more, and a basic software (OS) achieving multitask and multiwindow.

The performance measuring device for the golf club according to the invention once stores an image of the golf ball photographed by the camera in the control box, and transmits the image from the control box through the USB communication cable to the mobile type computer, which then receives and analyzes the image, whereby the control part of the conventional device is divided into the control box and the mobile type computer to reduce the size of the device, and the mouse, keyboard and monitor provided separately are unnecessary. Therefore, the movement of the equipment is simple, the trouble due to vibrations at the time of movement or the trouble due to dust is less likely to occur, it takes a shorter time to connect the power cable or the communication cable, the control part is installed in a narrow place, and it is unnecessary to copy data onto the media for data analysis.

The performance measuring device for the golf club according to the invention has the following effects.

1. Since the control box is employed mainly as the data storage part and the USB interface, and the mobile type computer has a function of analyzing the measured data and an image display function, the device of the invention is smaller and lighter than the conventional device, the mouse, keyboard and monitor provided separately are unnecessary, and the number of cables is reduced. Therefore, the movement of the equipment is simple, and the trouble due to vibrations at the time of movement or the trouble due to dust is less likely to occur. Also, it takes a shorter time to connect the cables, the control part is installed in a narrow place, and it is unnecessary to copy data onto the media for data analysis.

2. Since the measured data is saved in the mobile type computer, when the data analysis is made, it is unnecessary to save the data on the media as conventionally performed, whereby the data analysis is directly made on the mobile type computer employing the software.

3. When the measurement of data is not made, the mobile type computer is carried to another place and utilized for another business, making effective use of the device.

DETAILED DESCRIPTION OF THE INVENTION

Figure 1:
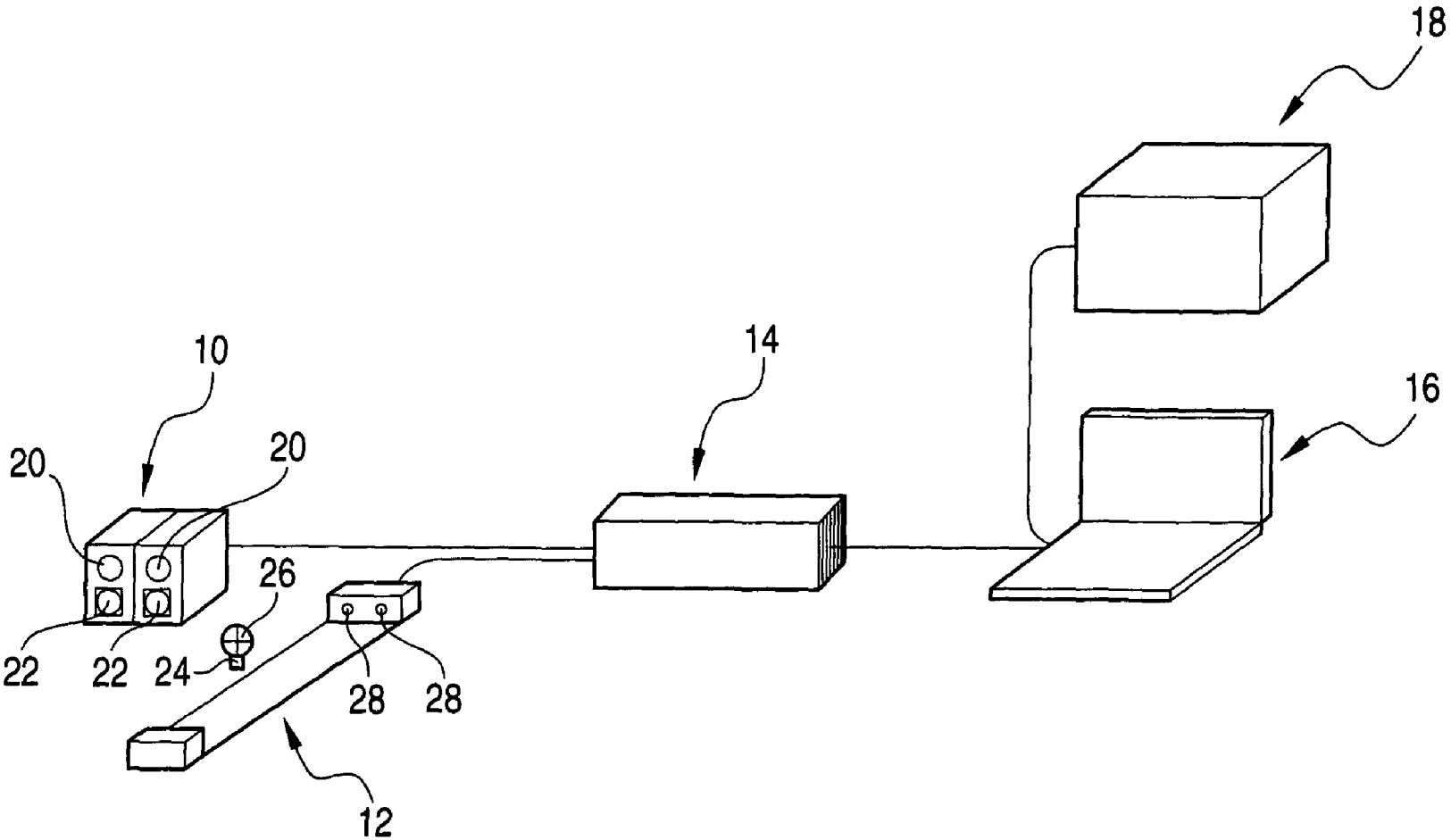
FIG. 1 is a schematic view showing one example of a performance measuring device of golf ball according to the invention.
Figure 2:
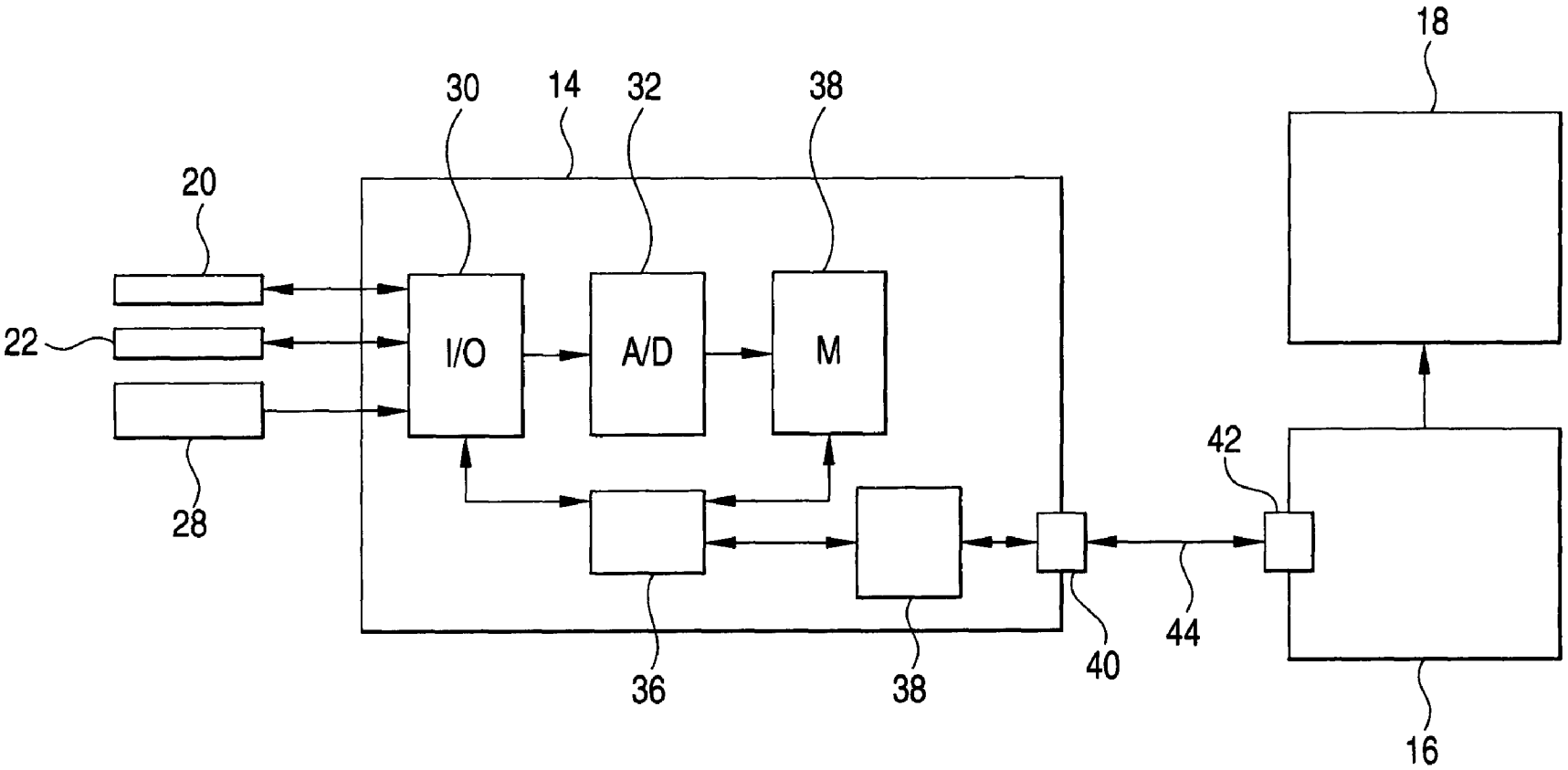
FIG. 2 is a block diagram of the device as shown in FIG. 1.

The preferred embodiments of the present invention will be described below with reference to the drawings. However, this invention is not limited to those embodiments. FIG. 1 is a schematic view showing one example of a performance measuring device of golf ball according to the invention. FIG. 2 is a block diagram of the device as shown in FIG. 1. This device includes a camera part 10, a sensor part 12, a control box 14, a mobile type computer 16, and a printer part 18.

The camera part 10 includes a pair of cameras 22 having a stroboscope 20 which are spaced from each other with a preset distance, for example, from 100 to 250 mm, in a direction along the fly ball line of the hit golf ball. In this case, the distance between the golf ball 26 on a set tee 24 and a camera 22 closer to this golf ball 26 in the direction along the fly ball line of the golf ball may be set to from 50 to 300 mm, for example.

The sensor part 12 includes a pair of optical sensors 28 composed of a light emitting part and a light receiving part which are spaced from each other with an interval of about 70 mm, for example. In this case, the distance between the golf ball 26 on the set tee 24 and an optical sensor 28 closer to this golf ball 26 in the direction of passage of the golf club may be preferably set to about 40 mm.

When the player faces the camera 22, and hits the golf ball 26 set on the tee 24 with the golf club, one pair of optical sensors 28 detect a passage of the golf club prior to hitting. And the time for which the club head passes between both sensors 28 is measured, and the head speed is calculated from the relationship with the distance between both sensors 28. Then, a trigger output for deciding the photographing timing of the golf ball by receiving a detection signal of the sensor 28 closer to the ball 26 acts on the camera 22 and the stroboscope 20 of the camera part 10. In this case, the above one series of operations is performed under the control of the control box 14 and the mobile type computer 16.

The trigger output is given by measuring beforehand a plurality of head speeds to be applied, and setting a delay time and a shutter interval time of both cameras 22 corresponding to each head speed on the mobile type computer 16. The delay time as used herein means the time since the sensor 28 detects the passage of the club head till the shutter and stroboscope 20 of the camera 22 are activated. The camera 22 is preferably a CCD camera having a shutter speed from $1/10000$ to $1/200000$ sec. The image of the golf ball photographed by the camera part 10 is sent to the control box 14.

The control box 14 includes a signal input/output part 30, a signal conversion part 32 for converting an analog signal into digital form, a data storage part 34, a signal image control part 36, a USB interface 38 and a USB terminal 40, as shown in FIG. 2. The image of the golf ball photographed by the camera part 10 is stored via the signal input/output part 30 and the signal conversion part 32 and the data storage part 34. The delay time and the shutter interval time associated with the trigger output corresponding to each head speed are saved in the mobile type computer 16.

The mobile type computer 16 is a general-purpose notebook type personal computer, for example, and includes an arithmetical operation processing part for analyzing the image sent via the USB interface of the control box, a liquid crystal monitor for displaying its analytic result, cursor control means such as a keyboard, a touch pad or the like, and a USB terminal 42. The arithmetical operation processing part of the mobile type computer 16 includes a CPU (Central Processing Unit) having a clock frequency of 500 MHz or more, preferably 1 GHz or more, and the basic software (e.g., Windows®) for implementing the multitask and multiwindow.

The printer part 18 may be a general-purpose ink jet printer, or a laser printer, for example.

In making the performance measurement for the golf club with the device of this embodiment, when the golf ball 26 set on the tee 24 is hit by the golf club, the sensor part 12 detects the passage of the club head and sends a detection signal through the control box 14 to the mobile type computer 16. The mobile type computer 16 computes the head speed from the detection signal, and sends a trigger signal corresponding to the acquired head speed to the camera 22 and the stroboscope 20 of the camera part 10. After the golf ball is hit by the club head, the golf ball is photographed at the moment when it comes in front of each camera 22. The photographed image is stored for each kind of club and each setting condition in the data storage part 34.

The image stored in the data storage part 34 is transferred through the signal image control part 36 via the USB interface 38 to the USB terminal 40, and then via the USB communication cable 44 and the USB terminal 42 to the mobile type computer 16 to perform the analytic processing. The signal image control part 36 performs the input/output of the camera image, a stroboscopic flash timing process, the write and read control of the image memory, and the centralized control of image output to the USB interface.

In this device, the USB 2.0 having a transfer rate of 480 Mbps is employed as the USB interface 38. That is, though the USB 1.1 having a transfer rate of 40 Mbps may be employed as the USB interface 38 to attain a high transfer rate, the use of USB 2.0 can greatly increase the transfer rate. The USB (Universal Serial Bus) is the interface standard capable of connecting various peripheral devices with a common connector.

The mobile type computer 16 internally includes the software for calculating and displaying various characteristics regarding the hit ball and the golf club. And the calculation and display of the numerical values of head speed, initial speed of the hit ball, delivery angle (upper direction to the horizontal line, left and right direction to the reference line), back spin amount, and side spin amount, calculation of a trajectory and a carry, display of the image based on the calculation results, and accumulation of the analytic results are made. Also, the printer part 18 is connected to the mobile type computer 16, as needed, to print various calculation results and images. The above various characteristics can be calculated by an image processing method using the image of hit ball, for example.

What is claimed is:

1. A performance measuring device for a golf club that measures a motion state of a golf ball hit by the golf club and displays a measurement result, comprising:

a camera part which takes a picture of the hit golf ball, wherein the camera part comprises a pair of cameras disposed horizontally to each other;

a sensor part which detects a passage of the golf club hitting the golf ball and sends a trigger signal of deciding a photographing timing of the golf ball to the camera part;

a strobe light part;

a control box comprising:

a signal input/output unit connected to the camera part, the strobe light part, and the sensor part;

an analog/digital converter connected to the signal input/output unit;

a storage unit which stores an image of the golf ball photographed by the camera part, the image being quantized by the analog/digital converter;

an interface which sends the image; and a control unit configured to control:

the signal input/output unit to control a stroboscopic action of the strobe light part and to receive the picture from the camera part;

the storage unit to store the image; and the interface to output the image stored in the storage unit; and a mobile computer comprising:

an arithmetical operation unit which analyzes the image sent via the interface of the control box;

a liquid crystal monitor which displays an analytic result;

a central processing unit (CPU); and a basic software (OS) achieving multitask and multiwindow, wherein the control box is physically separated from the mobile computer.

2. The performance measuring device according to claim 1, wherein the interface of the control box is a USB 2.0 having a transfer rate of 480 Mbps.

3. The performance measuring device according to claim 1, further comprising:

a printer part which prints the analytic result of the arithmetical operation part of the mobile computer.

4. The performance measuring device according to claim 1, wherein the interface sends the image from the storage unit to the mobile computer.

5. The performance measuring device according to claim 1, wherein the sensor part comprises a pair of optical sensors, wherein the pair of optical sensors detect a passage of the golf club prior to hitting and measures a time for which the club head passes between the pair of optical sensors.

6. The performance measuring device according to claim 5, wherein a head speed is calculated from the relationship of the distance between the pair of optical sensors and the time.

7. The performance measuring device according to claim 1, wherein a distance from the golf ball to at least one of the pair of cameras is 100 to 250 mm in a direction along a fly ball line of the golf ball.

8. The performance measuring device according to claim 1, wherein the interface comprises a USB interface.

9. The performance measuring device according to claim 1, wherein a distance between the camera part and the sensor part is adjustable.

10. The performance measuring device according to claim 1, wherein the camera part and the sensor part are horizontally disposed relative to each other.

11. A performance measuring device, configured to connect to a mobile computer, comprising:

a camera part which takes a picture of a hit golf ball, wherein the camera part comprises a pair of cameras disposed horizontally to each other;

a sensor part which detects a passage of a golf club hitting the golf ball and sends a trigger signal having a photographing timing to the camera part;

a strobe light part; and a control box comprising:

a signal input/output unit connected to the camera part, the strobe light part, and the sensor part;

an analog/digital converter connected to the signal input/output unit;

a storage unit which stores an image of the golf ball photographed by the camera part, the image being quantized by the analog/digital converter;

an interface which outputs the image for analysis by the mobile computer; and a control unit configured to control:

the signal input/output unit to control a stroboscopic action of the strobe light part and to receive the picture from the camera part;

the storage unit to store the image; and the interface to output the image stored in the storage unit, wherein the performance measuring device is a peripheral device of the mobile computer and wherein the interface is connectable to the mobile computer.

12. A performance measuring device for a golf club that measures a motion state of a golf ball hit by the golf club and displays a measurement result, comprising:

a camera part which takes a picture of the hit golf ball, wherein the camera part comprises a pair of cameras disposed horizontally to each other;

a sensor part which detects a passage of the golf club hitting the golf ball and transmits a detection signal;

a strobe light part;

a control box comprising:

a signal input/output unit connected to the camera part, the strobe light part, and the sensor part;

an analog/digital converter connected to the signal input/output unit;

a storage unit which stores an image of the golf ball photographed by the camera part, the image being quantized by the analog/digital converter;

an interface which sends the image; and a control unit configured to control:

the signal input/output unit to control a stroboscopic action of the strobe light part and to receive the picture from the camera part;

the storage unit to store the image; and the interface to output the image stored in the storage unit; and a mobile computer comprising:

an arithmetical operation unit which analyzes the image sent via the interface of the control box;

a liquid crystal monitor which displays an analytic result;

a central processing unit (CPU); and a basic software (OS) achieving multitask and multiwindow, wherein:

the control box is physically separated from the mobile computer;

the sensor part transmits the detection signal to the mobile computer via the control box;

the mobile computer computes a head speed using the detection signal and transmits a trigger signal corresponding to the head speed to the camera part and the strobe light part; and the camera part takes the picture of the hit golf ball when the golf ball is in front of each camera of the pair of cameras, and the image of the golf ball is stored in the storage unit.

* * * * *